US011749477B2

(12) United States Patent
Das et al.

(10) Patent No.: US 11,749,477 B2
(45) Date of Patent: Sep. 5, 2023

(54) VACUUM CIRCUIT INTERRUPTER WITH DUAL PLATE ACTUATION

(71) Applicant: Eaton Intelligent Power Limited, Dublin (IE)

(72) Inventors: Asish Das, Odisha (IN); Santhosh Kumar Chamarajanagar Govinda Nayaka, Moon Township, PA (US); Andrew L. Gottschalk, Monaca, PA (US); R. Michael Slepian, Murrysville, PA (US); Jayaraman Muniyappan, Tamil Nadu (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 115 days.

(21) Appl. No.: 17/236,262

(22) Filed: Apr. 21, 2021

(65) Prior Publication Data

US 2022/0344115 A1 Oct. 27, 2022

(51) Int. Cl.
*H01H 33/666* (2006.01)
*H01H 33/662* (2006.01)
(Continued)

(52) U.S. Cl.
CPC ..... *H01H 33/6661* (2013.01); *H01H 1/66* (2013.01); *H01H 33/66207* (2013.01); *H01H 50/20* (2013.01); *H01H 2033/6665* (2013.01)

(58) Field of Classification Search
CPC ..... H01H 33/6661; H01H 1/66; H01H 33/66207; H01H 50/20; H01H 2033/6665
See application file for complete search history.

(56) References Cited

U.S. PATENT DOCUMENTS 4,281,231 A * 7/1981 Griesen ..... H01H 33/664 218/123
4,331,998 A 5/1982 Matsko et al.
(Continued)

FOREIGN PATENT DOCUMENTS

DE 202012001498 U1 3/2012
KR 20170056970 A 5/2017

OTHER PUBLICATIONS

U.S. Appl. No. 16/907,425, filed Jun. 22, 2020, Variable-Speed Circuit Breaker and Switching Method for Same.
(Continued)

*Primary Examiner* — Bernard Rojas
(74) *Attorney, Agent, or Firm* — Eckert Seamans Cherin & Mellott, LLC

(57) ABSTRACT

A circuit breaker includes a vacuum interrupter. The interrupter includes a first movable electrode to which a first contact is connected and a second movable electrode to which a second contact is connected. The interrupter is operable between an open state and a closed state. In the open state, the first contact and the second contact are separated by a contact gap distance. In the closed state, the first contact and the second contact touch each other. The circuit breaker includes an ultrafast actuator operatively connected to each of the first and second movable electrodes. The ultrafast actuator is configured to change the vacuum interrupter from the closed state to the open state by simultaneously moving the first contact in a first direction along a first distance portion of the contact gap, and the second contact in a second direction along a second distance portion of the contact gap.

16 Claims, 7 Drawing Sheets

(51) Int. Cl.
*H01H 1/66* (2006.01)
*H01H 50/20* (2006.01)

(56) References Cited

U.S. PATENT DOCUMENTS

| | | | | |
|---|---|---|---|---|
| 6,126,152 | A | 10/2000 | Santos et al. | |
| 6,930,271 | B1 | 8/2005 | Palmieri et al. | |
| RE41,036 | E | 12/2009 | Bushey et al. | |
| 7,829,814 | B2 | 11/2010 | Marchand et al. | |
| 8,791,779 | B2 | 7/2014 | Jonsson | |
| 8,982,538 | B2 | 3/2015 | Leccia et al. | |
| 9,396,896 | B2 | 7/2016 | Chen et al. | |
| 9,842,713 | B2 | 12/2017 | Yu et al. | |
| 10,580,599 | B1 | 3/2020 | Wang et al. | |
| 10,957,505 | B2 | 3/2021 | Chen et al. | |
| 2017/0154747 | A1 | 6/2017 | Bissal et al. | |
| 2018/0294115 | A1* | 10/2018 | Hwang | H01H 3/0253 |
| 2020/0279709 | A1* | 9/2020 | Chen | H01H 71/2454 |
| 2020/0402752 | A1 | 12/2020 | Leccia et al. | |
| 2020/0411261 | A1 | 12/2020 | Zhou et al. | |

OTHER PUBLICATIONS

Bini, R. et al., "Interruption Technologies for HVDC Transmission: State-of-Art and Outlook", 2017 4th International Conference on Electric Power Equipment—Switching Technology-Xi'an-China, downloaded May 12, 2020.

Pei, X. et al., "Fast operating moving coil actuator for a vacuum", IEEE Transactions on Energy Conversion, 32(3), 931-940, 2017.

* cited by examiner

VACUUM CIRCUIT INTERRUPTER WITH DUAL PLATE ACTUATION

BACKGROUND

Circuit breakers can be used to protect electrical power systems and downstream devices from fault conditions such as current overloads, short circuits, and high or low voltage conditions. A design challenge for an effective circuit breaker is that the breaker should have a fast-acting mechanism to open its electrical contacts. For example in a hybrid circuit breaker that includes both mechanical and solid-state components, the fast-acting mechanism opens the electrical contacts quickly so that the current is commutated, for example, to a semiconductor branch for only a small span of time, before the current crosses the maximum current handling capability of any semiconductor switches.

In a conventional circuit breaker actuator using a Thomson coil, a plate will be connected to the breaker's moving component and the Thomson coil will be placed adjacent to the plate. The nature of the force produced by a Thomson coil is a sudden impulse acting on the plate of the actuator, which in turn causes the circuit breaker's moving contact to separate from the circuit breaker's stationary contact. Such conventional actuators have operational limits because the total moving mass has a big impact on the travel distance that can be achieved. Moreover, as the mass of the moving parts increases, a higher amount of energy is needed from the energy source to excite the Thompson coil.

This document describes methods and systems that are intended to address some or all of the problems described above.

SUMMARY

Some embodiments of a circuit breaker include a vacuum interrupter. The interrupter includes a first movable electrode to which a first contact is connected and a second movable electrode to which a second contact is connected. The vacuum interrupter is operable between an open state and a closed state. In the open state, the first contact and the second contact are separated by a contact gap. In the closed state, the first contact and the second contact touch each other. The circuit breaker includes an ultrafast actuator operatively connected to the each of first and second movable electrodes. The ultrafast actuator is configured to change the vacuum interrupter from the closed state to the open state by simultaneously moving the first contact in a first direction along a first distance portion of the contact gap, and the second contact in a second direction along a second distance portion of the contact gap.

In various embodiments, the ultrafast actuator may include a Thomson coil or a piezo-electric actuator.

In various embodiments, the ultrafast actuator may also include a first repulsion plate that is operatively coupled to the first electrode, and a second repulsion plate that is operatively coupled to the second electrode. The Thomson coil or the piezo-electric actuator may be disposed between the first repulsion plate and the second repulsion plate.

In various embodiments, the circuit breaker may further include a vacuum interrupter housing that is configured to house the first electrode, the first contact, the second electrode and the second contact. The circuit breaker also may include a chamber travel assembly that includes a travel substrate that is movably coupled relative to a first end of the vacuum interrupter housing, a support plate that is coupled to the first repulsion plate and movably coupled relative to a second end of the vacuum interrupter housing, and parallel rods that connect the support plate to the travel substrate.

In various embodiments, the vacuum interrupter may further include a fixed central electrode. The first contact is movably relative to a first side of the central electrode by the first distance portion. The second contact is movable relative to a second side of the fixed central electrode by the second distance portion. The first side and the second side are opposite sides.

In various embodiments, the vacuum interrupter housing may include a first housing section that is configured to receive and house the first contact; a second housing section that is configured to receive and house the second contact; and a housing divider section including the fixed central electrode. The housing divider section is between the first housing section and the second housing section.

In various embodiments, the circuit breaker may further include a contact force applicator. The contact force applicator may include a first spring assembly including a first compression spring that is configured to generate a first compression force that will force the first electrode and the first contact toward the second contact, and a second spring assembly including a second compression spring that is configured to generate a second compression force that will force the second electrode and the second contact toward the first contact.

In various embodiments, the first compression force is in a direction opposite the first direction of the force generated by the first repulsion plate. The second compression force is in a direction opposite the second direction of the force generated by the second repulsion plate. The first compression force and the second compression force reduce the contact gap distance between the first contact and the second contact to cause the closed state of the vacuum interrupter.

In various embodiments, the first distance portion of the contact gap and the second distance portion of the contact gap are equal.

In various embodiments, a method for operating a circuit breaker is provided. The method includes providing a vacuum interrupter that is operable to move from a closed state an open state. The vacuum interrupter includes a first movable electrode to which a first contact is connected, and a second movable electrode to which a second contact is connected. In the open state, the first contact and the second contact are separated by a contact gap. In the closed state, the first contact and the second contact touch each other. The method includes operating an ultrafast actuator that is operatively connected to the first and second movable electrodes to change the vacuum interrupter from the closed state to the open state by simultaneously moving the first contact in a first direction along a first distance portion of the contact gap, and the second contact in a second direction along a second distance portion of the contact gap.

DETAILED DESCRIPTION

Figure 1:
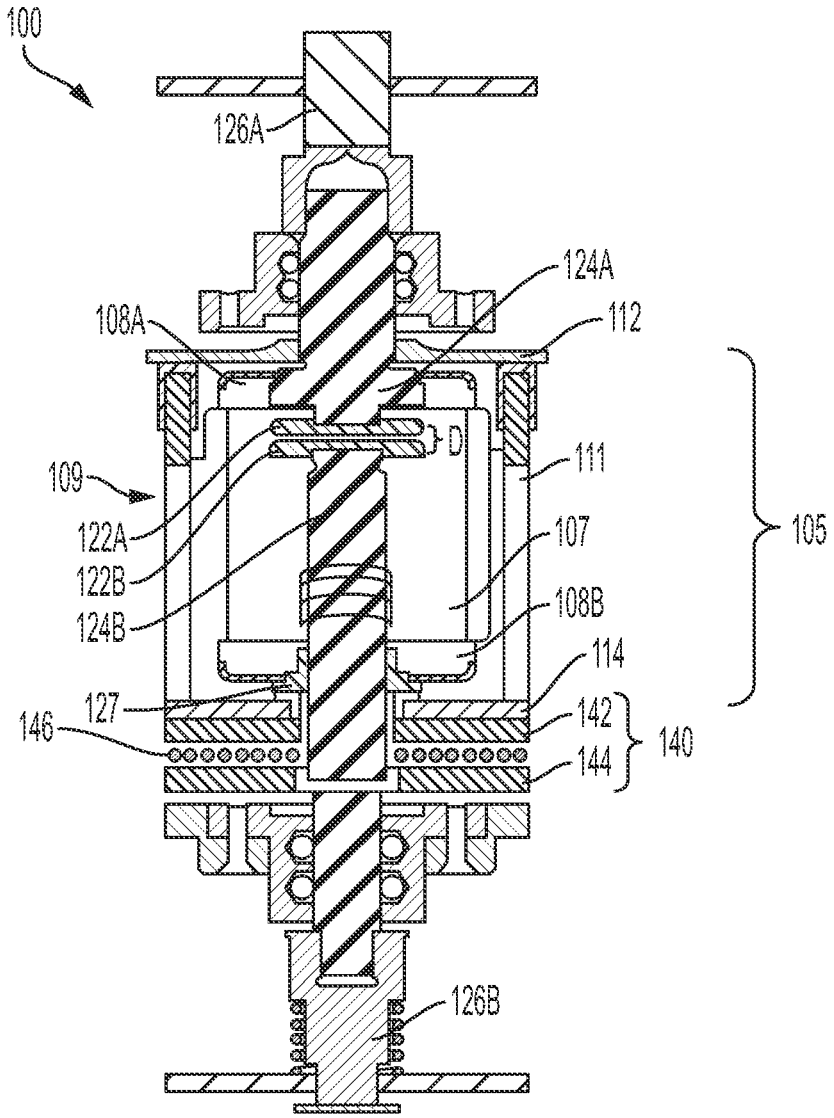
FIG. 1 is a sectional view of a circuit breaker with certain internal components shown.

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", "upward" and "downward", or "front" and "rear," are not intended to have absolute orientations but are instead intended to describe relative positions of various components with respect to each other. For example, a first component may be an "upper" or "upwardly moving" component and a second component may be a "lower" or "downwardly moving" component when a device of which the components are a part is oriented in a direction in which those components are so oriented with respect to each other. The relative orientations of the components may be reversed, or the components may be on the same plane with movement in directions away from each other, if the orientation of the structure that contains the components is changed. The claims are intended to include all orientations of a device containing such components.

In "high voltage" electrical systems such as those that exist in large power plants (typically over 100 kV), the vacuum interrupters used in such systems are subject to high rated currents and high interruption currents. "Medium voltage" (MV) systems include electrical systems that are rated to handle voltages from about 600 V to about 1000 kV. Some standards define MV as including the voltage range of 600 V to about 69 kV. (See NECA/NEMA 600-2003.) Other standards include ranges that have a lower end of 1 kV, 1.5 kV or 2.4 kV and an upper end of 35 kV, 38 kV, 65 kV or 69 kV. (See, for example, IEC 60038, ANSI/IEEE 1585-200 and IEEE Std. 1623-2004, which define MV as 1 kV-35 kV.) Except where stated otherwise, in this document the term "medium voltage" is intended to include the voltage range from approximately 1 kV to approximately 100 kV, as well as all possible sub-ranges within that range, such as approximately 1 kV to approximately 38 kV. The circuit breaker disclosed herein has application for use in high voltage and medium voltage electrical systems. The circuit breaker may be used in low voltage electrical systems, as well.

The circuit breaker disclosed herein is capable of interrupting current extremely quickly by displacing simultaneously and in opposite directions each contact of a pair of contacts by a single repulsion force.

Figure 2:
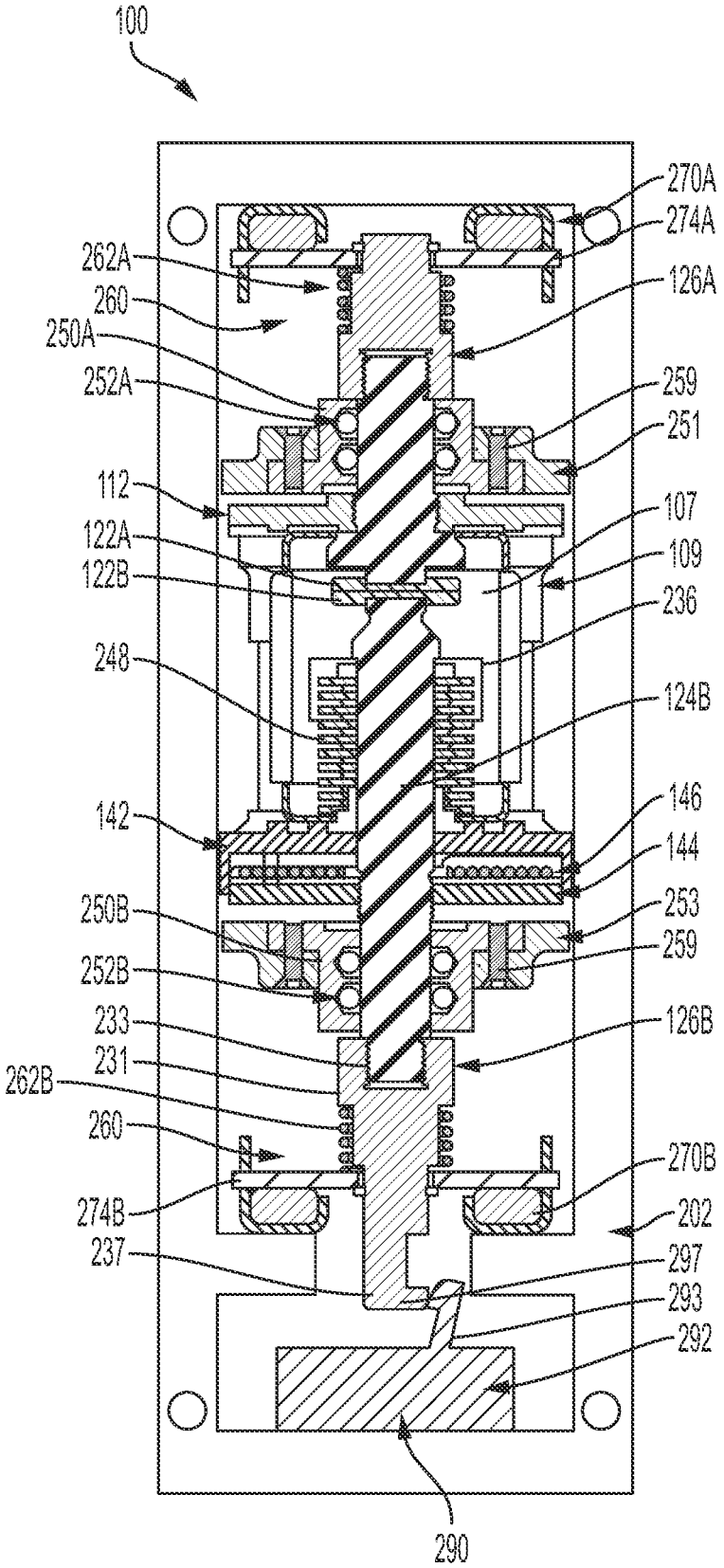
FIG. 2 is a sectional view of the circuit breaker of FIG. 1 within a housing and with additional features shown.

FIG. 1 illustrates a sectional view of a circuit breaker 100 with certain internal components shown. The circuit breaker 100 may be a vacuum interrupter switch in accordance with an aspect of the disclosure. The terms circuit breaker and vacuum interrupter switch may be used interchangeably herein. In some embodiments, the circuit breaker 100 may be employed in a direct current (DC) system to interrupt DC power. In other embodiments, the circuit breaker 100 may be employed in an alternating current (AC) circuit, for example as a single pole of a three-pole AC circuit breaker. The circuit breaker 100 may include a vacuum interrupter 105 having an open position, as seen in FIG. 1 in which contacts 122A and 122B are separated by a contact gap D, and a closed position, as seen in FIG. 2 in which contacts 122A and 122B touch each other and are not separated by a contact gap. The closed position corresponds to a closed state and the open position to an open state of the vacuum interrupter 105.

The circuit breaker 100 may include upward moving components and downward moving components. The upward moving components are assembled together to move in unison upward (e.g., a first direction). The assembled upward moving components may sometimes be referred to as a "first movable component assembly." On the other hand, the downward moving components are assembled together to move in unison downward (e.g., a second direction). The first direction and the second direction are opposite directions. The assembled downward moving components may sometimes be referred to as a "second movable component assembly." Note that the structure shown in FIG. 1 may be inverted, or oriented in any other position. Thus, in this document the terms "upward" and "downward" are merely intended to indicate relative directions of movement away from each other, and not necessarily strictly "up" or "down."

The vacuum interrupter 105 of the circuit breaker 100 may include a vacuum interrupter chamber 107, an upward-movable first electrode 124A and a downward-movable second electrode 124B. Each electrode 124A, 124B has a portion of its length within the vacuum interrupter chamber 107. The vacuum interrupter 105 may include a first contact 122A that is connected to a first electrode 124A and a second contact 122B that is connected to a second electrode 124B.

Optionally, either or both of the movable electrodes 124A, 124B may be operatively connected to a movable linkage member, such as a support shaft. For example, in FIG. 1, upwardly movable electrode 124A is operably connected to upwardly moving first linkage member 126A, while downwardly movable electrode 124B is operably connected to a downwardly movable second linkage member 126B. Each linkage member 126A, 126B may be a non-conductive extension of the electrode to which it is attached, to link the electrode to one or more components outside of the chamber 107. Each electrode (such as second electrode 124B) and its corresponding linkage member (such as linkage member 126B) may together form an elongated pole.

The upward moving components in the configuration shown in FIG. 2 may include the first electrode 124A, the first contact 122A and the first linkage member 126A, the chamber 107 and a chamber travel assembly 109 (described below). The downward moving components may include the second electrode 124B, the second contact 122B and the second linkage member 126B that is attached to the second contact 122B. These groups of components may be reversed if the Thomson coil 146 is positioned above the chamber 107. The upward moving components may be configured to move in unison with and in an opposite direction of the downward moving components, in response to the single repulsion force.

The chamber 107 may be an insulated and hermetically sealed vacuum chamber that includes a first end 108A and a second end 108B. In various embodiments, the chamber 107 may be a conventional vacuum interrupter bottle. The chamber 107 may be surrounded by a chamber travel assembly 109 that may be configured to move upward and, when doing so, draw the vacuum interrupter chamber 107 upward with it. The upward moving components may include the chamber travel assembly 109. The chamber travel assembly 109 may include a travel substrate 112 in proximity to and/or coupled to a first end 108A of the chamber 107. The chamber travel assembly 109 may include a support substrate 114 in proximity to the second end 108B of the chamber 107. The chamber travel assembly 109 may include connecting structures such as push rods 111. Each rod 111 may have a first end connected to the travel substrate 112 and a second end opposite the first end connected to the support substrate 114. The rods 111 and the travel substrate 112 are formed of non-conducting material and therefore are non-conducting. Optionally, the push rods 111 extending from the travel substrate to the support substrate may be configured as relatively narrow rods, or as wider structures such sidewall segments, or even as a single sidewall that extend around all or a portion of the vacuum interrupter chamber 107.

The first end 108A of the chamber 107, the travel substrate 112 or both will be mechanically connected to the first electrode 124A so that when the chamber travel assembly 109 moves upward, the travel substrate 112 pulls the first electrode 124A upward with it. The mechanical connection may be a threaded connection or another mechanical fit. The second end 108B of the chamber 107, as well as the support substrate 114, may include a non-conductive interface 127 that allows the second electrode 124B to slideably extend through the interface 127 and move between an open position and a closed position within the chamber 107.

The circuit breaker 100 includes an ultrafast actuator 140 that may be a two-sided moving contact mechanism. In operation, the ultrafast actuator 140 is mechanically connected to each electrode 124A, 124B, and by simultaneously moving the electrodes away from each other causing each contact 122A, 122B to travel along respective portions of the length of the contact gap distance D, simultaneously, to create the net separation. Therefore, in an interval of time, each contact 122A, 122B simultaneously moves in opposite directions in unison to create the net separation. The ultrafast actuator 140 may include repulsion plates 142 and 144 and an actuator member 146.

The net separation may be a function of both a first distance portion traveled by contact 122A in a first direction and a second distance portion traveled by contact 122B in a second direction that is opposite the first direction. Each of the first distance portion and second distance portion has a value that is greater than zero (0). In some embodiments, the first distance portion and the second distance portion are equal. In such an embodiment, the first distance portion and the second distance portion are equal to ½ of the contact gap distance. In other embodiments, the first distance portion and the second distance portion are not equal. In some embodiments, the net separation is not a continuous gap, such as shown in FIG. 4B.

In the example where the first distance portion and the second distance portion are equal to ½ of the full contact gap distance, the ultrafast actuator 140 may open (e.g., separate) the pair of contacts 122A, 122B in half the time that it would take to move only one contact the full contact gap distance. Even if the ultrafast actuator 140 moves the contacts by different amounts during the same time interval of time, the time to achieve an open circuit condition by the vacuum interrupter may be achieved at a faster rate when compared to other vacuum interrupter type circuit breakers. The net separation may be doubled or more than double for the same total moving mass for a given time interval.

Although not shown, the ultrafast actuator 140 may include permanent magnets positioned proximate to the Thomson coil 146 (i.e., the actuator member 146) and a permanent magnet on each repulsion plate 142, 144 that will latch the repulsion plates with the Thomson coil, when the vacuum interrupter 105 is closed. Other locking structures are possible.

In operation, as the repulsion plate 142 is repelled, a force is exerted on support substrate 114 to push it upward. As the support substrate 114 is pushed upward, the push rods 111 are pushed upward in unison. By way of non-limiting example, the push rods 111 push the travel substrate 112 with the force exerted by the repulsion plate 142, which in turn pushes the first electrode 124A upward. This causes the first contact 122A to move upward in unison with the first electrode 124A.

The first linkage member 126A may be operatively coupled to the travel substrate 112 and the first electrode 124A. By way of non-limiting example, the first linkage member 126A may be operatively coupled, via a threaded connection, to the travel substrate 112. As the first electrode 124A is moved upward, the first linkage member 126A is moved upward as well.

Figure 3:
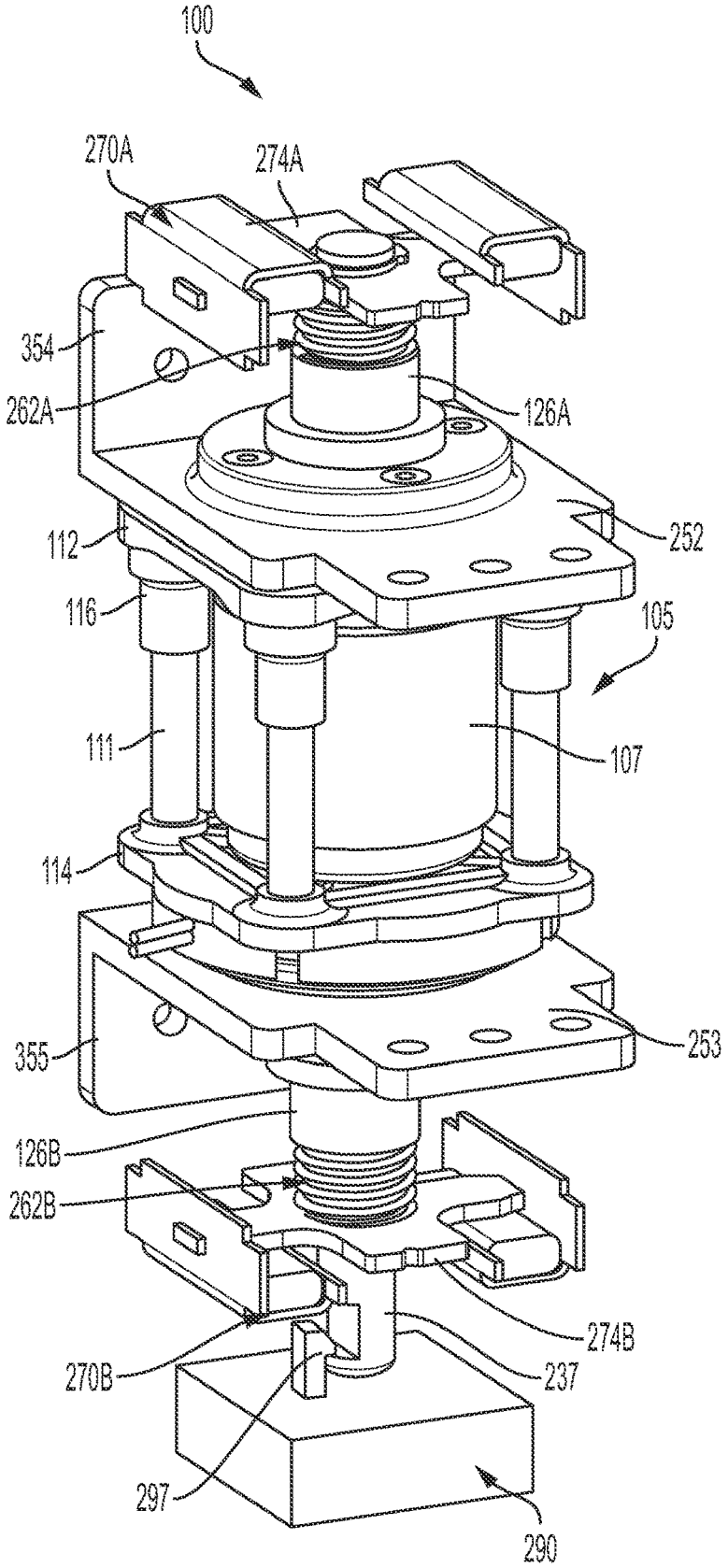
FIG. 3 is an isometric view of the circuit breaker of FIG. 1 with the circuit breaker housing removed.

Additional components of the circuit breaker 100 will be described in relation to FIGS. 2 and 3. FIG. 2 illustrates a sectional view of the circuit breaker 100 of FIG. 1. FIG. 3 illustrates an isometric view of the circuit breaker 100 of FIG. 1 with the circuit breaker housing removed.

The circuit breaker 100 may include a first spring housing 250A and a first conducting spring 252A housed in the spring housing 250A. In various embodiments, the first spring housing 250A may include a first recess that receives the first electrode 124A into the first spring housing 250A. The travel substrate 112 may include a collar configured to interface with the first electrode 124A, such as by a threaded connection as described above. The collar may be moved in some instances within the first recess. The linkage member 126A rests on the first spring housing 250A when the vacuum interrupter 105 is in a closed position. A first conducting spring 252A may be circumferentially arranged around the first electrode 124A. If so, then when the breaker opens the first electrode 124A may move upward into a cavity of the first spring housing 250A. Alternatively, the first electrode 124A may be fixed within the cavity, and the first linkage member 126A may be upwardly movable as the first spring housing 250A moves upwards. In any of these situations, as the first electrode 124A moves to an open position, it will move first linkage member 126A upward until the first spring assembly 262A pushes back on first linkage member 126A, as will be described below. Optionally, the first electrode 124A may be movable within the first spring housing 250A and the first linkage member 126A may be movable with the first spring housing 250A.

A line conductor or a load conductor (not shown) will be connected to the first electrode 124A and will extend out from the first spring housing 250A to other components of an electrical circuit of which circuit breaker 100 is a part.

The downward moving components may include a second spring housing 250B with a second cavity, a second conducting spring 252B and a second linkage member 126B. The modes of operation of these components may be any of those discussed above for the corresponding upward moving components. In various embodiments, conducting springs 252A and 252B may have a rolling motion. In various embodiments, one or more moving components may be made to remain stationary.

The circuit breaker 100 may include a circuit breaker housing 202 that is configured to surround the upward moving components and the downward moving components, for example.

The circuit breaker 100 may include a line conductor 251 that is coupled to the spring housing 250A via fasteners 259. The line conductor 251 may include a bracket 354 (FIG. 3) that is configured to be mounted to the circuit breaker housing 202 via fasteners (not shown).

The circuit breaker 100 may include a load conductor 253. The load conductor 253 may be coupled to a spring housing 250B via fasteners 259. The spring housing 250B may be configured to receive the second moving linkage member 126B such that the conducting spring 252B is circumferentially arranged around the second moving linkage member 126B. The load conductor 253 may include a bracket 355 (FIG. 3) that may be configured to be mounted to the circuit breaker housing 202 via fasteners (not shown). The second moving linkage member 126B may be configured to move within the spring housing 250B.

Terminals (not shown) of the line conductor 251 may be electrically connected to a power source and terminals (not shown) of the load conductor 253 may be electrically connected to a load, thus positioning the vacuum interrupter 105 to interrupt the delivery of power to the load when the contacts 122A, 122B are separated.

The circuit breaker 100 may include a contact force applicator 260 that includes a first spring assembly 262A and a second spring assembly 262B. Each spring assembly 262A, 262B may include a compression spring to create a corresponding compression force to close the contacts 122A, 122B via the moving electrodes 124A, 124B. The first spring assembly 262A may be operatively connected to the upward moving components to force the first electrode 124A having the first contact 122A toward the second electrode 124B and its corresponding second contact 122B. The (first) compression force applied by the first spring assembly 262A is in a direction opposite the direction of the repulsion force generated by the repulsion plate 142.

The second spring assembly 262B may be operatively connected to the downward moving components to force the second electrode 124B having the second contact 122B toward the first electrode 124A and its corresponding first contact 122A. The (second) compression force applied by the second spring assembly 262B is in a direction opposite the direction of the repulsion force generated by the repulsion plate 144.

The circuit breaker 100 may include first and second damping assemblies 270A, 270B, in some scenarios. The first dampening assembly 270A may be coupled to the upward moving components via a plate that is fixed at the ends and can flex under load, and which this provides the function of a leaf spring 274A and the circuit breaker housing 202. The first spring assembly 262A is positioned around the support shaft of the linkage member 126A and extends up to the leaf spring 274A. The leaf spring 274A bends when impacted by linkage member 126A during an "opening event" and transfers the energy to the dampening assembly 270A. The second dampening assembly 270B may be coupled to the downward moving components via leaf spring 274B and to the circuit breaker housing 202. The second spring assembly 262B is positioned around the support shaft of linkage member 126B and extends down to the leaf spring 274B. The first and second damping assemblies 270A, 270B absorb impact forces exerted by the upward moving components, the downward moving components and/or the contact force applicator 260. Each damping assembly 270A, 270B may include a rubber pad or plastic pad. The first and second damping assemblies 270A, 270B may include rubber to remove shock forces. The leaf springs 274A and 274B include a plate that is hardened and held at the ends.

Each linkage member 126A and 126B has a shoulder. For example, a gap is formed between the shoulder of the linkage member 126A and leaf spring 274A. When the Thomson coil is activated to open the contacts 122A, 122B, linkage member 126A moves up until the gap is gone and linkage member 126A impacts the leaf spring 274A with a high force that bends the leaf spring 274A transferring the load into damping assembly 270A. The operation of the linkage member 126B, leaf spring 274B and damping assembly 270B is essentially the same expect in a downward direction.

To open the vacuum interrupter 105, the ultrafast actuator 140 may provide a force greater than the combined force by the atmospheric pressure and the contact force applicator 260. The contact force applicator 260 creates a compression force, which is derived from the first compression force generated by the first spring assembly 262A and/or the second compression force generated by the second spring assembly 262B. The repulsion plates 142, 144 may be configured to be repelled by the magnetic force generated by the Thomson coil (i.e., actuator member 146). As the repulsion plates 142, 144 are repelled, a repulsion force greater than the combined force by the atmospheric force and the contact force applicator 260, which closes the vacuum interrupter 105, causes the vacuum interrupter 105 to open.

The repulsion plates 142, 144 may be configured to be returned to an initial position, which is essentially next to the actuator member 146 so that the vacuum interrupter 105 can be returned to a closed position.

The circuit breaker 100 may include a latch assembly 290. The latch assembly 290 may include a support block 292 coupled to the circuit breaker housing 202. The support block 292 may include a movable upright member 293. A free end of the upright member 293 includes a flange 297. The second linkage member 126B may include a first end 231 having a linkage interface 233. The linkage interface 233 may be a threaded connection to connect to an end of the second electrode 124B. The second linkage member 126B may include a hook 237 at a second end opposite the first end 231. The hook 237 is adapted to latch onto the flange 297. The hook 237 is in an unlatched position when contacts 122A, 122B are closed, as shown in FIG. 2. The hook 237 is in a latched position when the contacts 122A, 122B are open. In various embodiment, the latch assembly 290 may limit the travel distance of the downward moving components of the circuit breaker 100 when the vacuum interrupter 105 returns to the closed position, as seen in FIG. 3, under the force exerted by the second spring assembly 262B. In other embodiments, the hook 237 may limit the travel distance of the downward moving components in the downward direction or in the direction of support block 292. The support block 292 may provide a stop member when the vacuum interrupter 105 is open. The first linkage member 126A may include a similar linkage interface to connect to an end of the first electrode 124A.

The details of the chamber 107 will now be described. The chamber 107 may include a vapor shield (not shown) and a cavity member 236 that may be cup-shaped. The cavity member 236 may be connected to the second electrode 124B. The chamber 107 may include a bellows 248 that is also connected to the second electrode 124B. The bellows 248 allow the second electrode 124B to move downward or upward through an opening in the chamber 107 while maintaining the vacuum in the chamber. The cavity member 236 may be positioned to protect the bellows 248 from overheating during an interruption event. The bellows 248 may be configured to permit the second contact 122B and the second electrode 124B of the downward moving components to move whether from a closed position to an open position or an open position to a closed position.

The chamber 107 as shown in FIG. 3 are not limited to the components or configuration described herein. Another housing arrangement will be described in relation to FIGS. 4A-4B and 5.

Figure 4A:
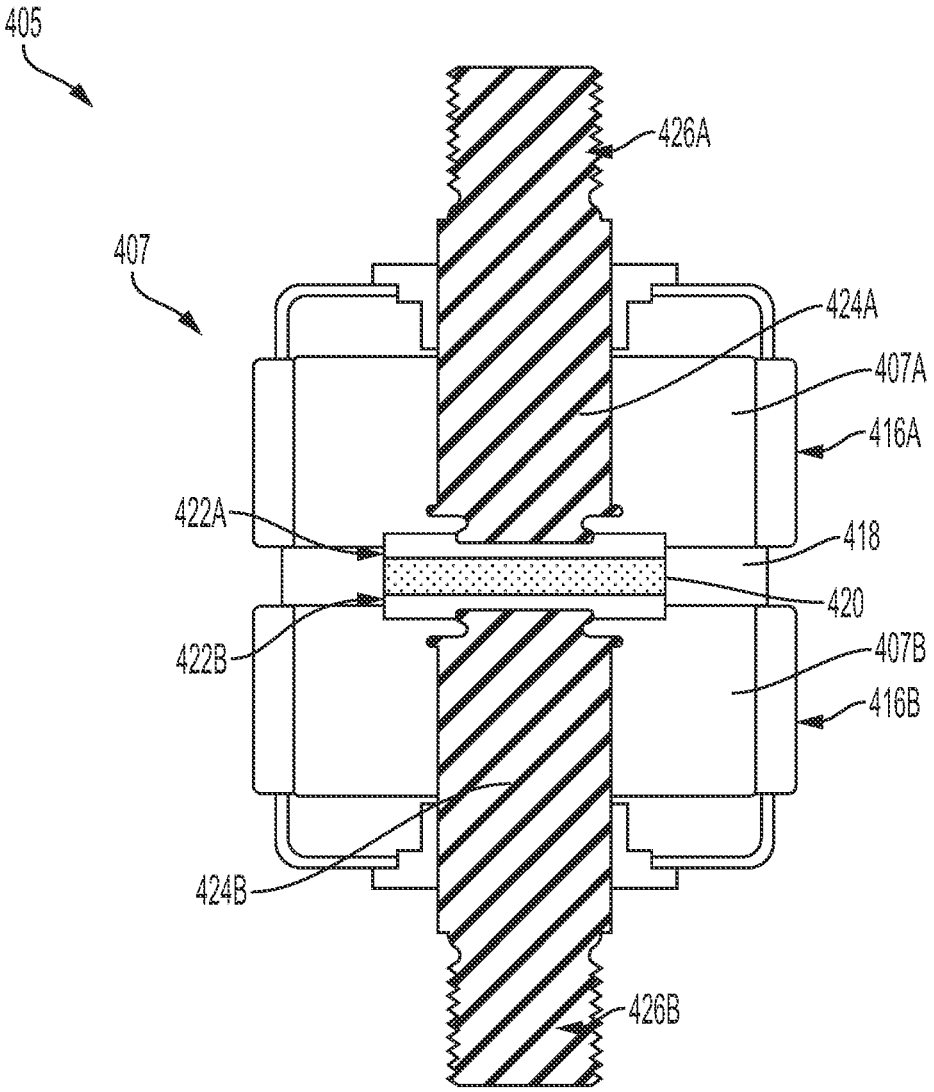
FIG. 4A is a sectional view of dual contact housing sections and certain internal components of a vacuum interrupter shown in a closed position.
Figure 4B:
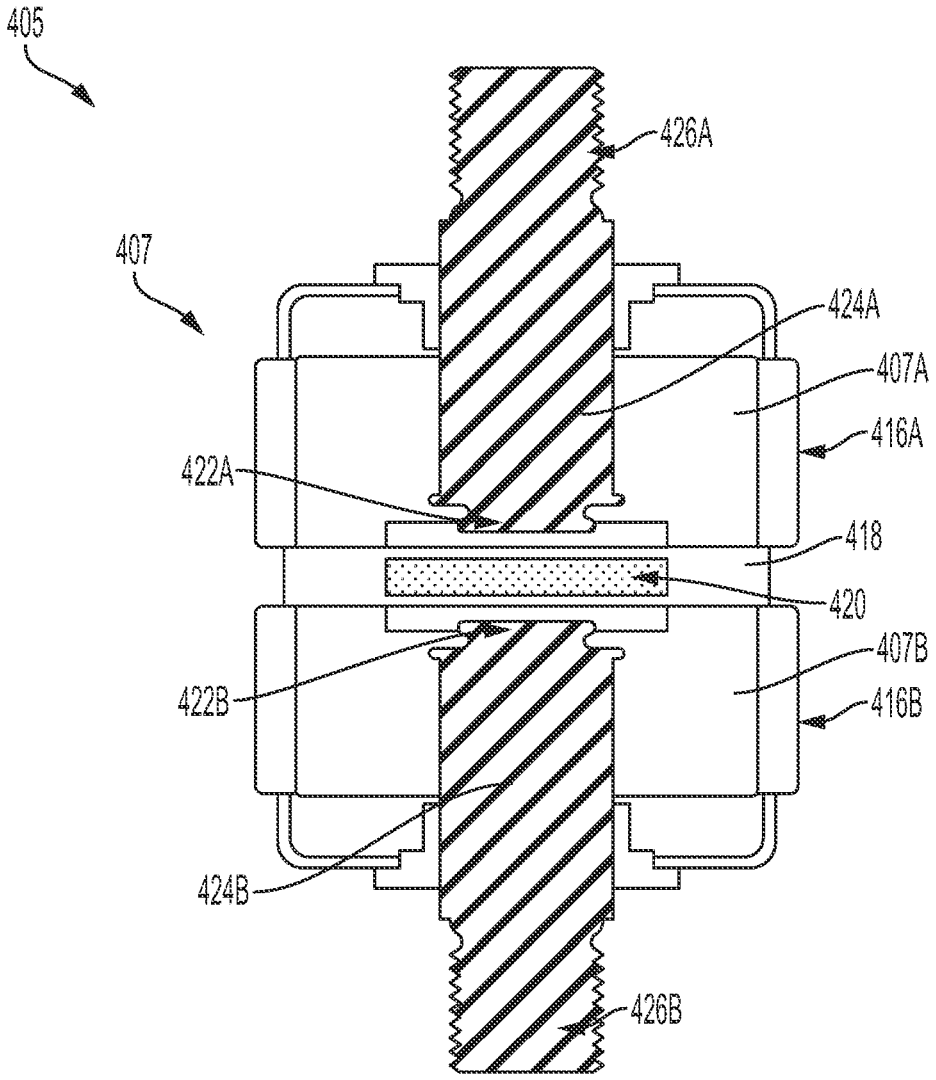
FIG. 4B is a sectional view of the dual contact housing sections and certain internal components of a vacuum interrupter shown in an open position.
Figure 5:
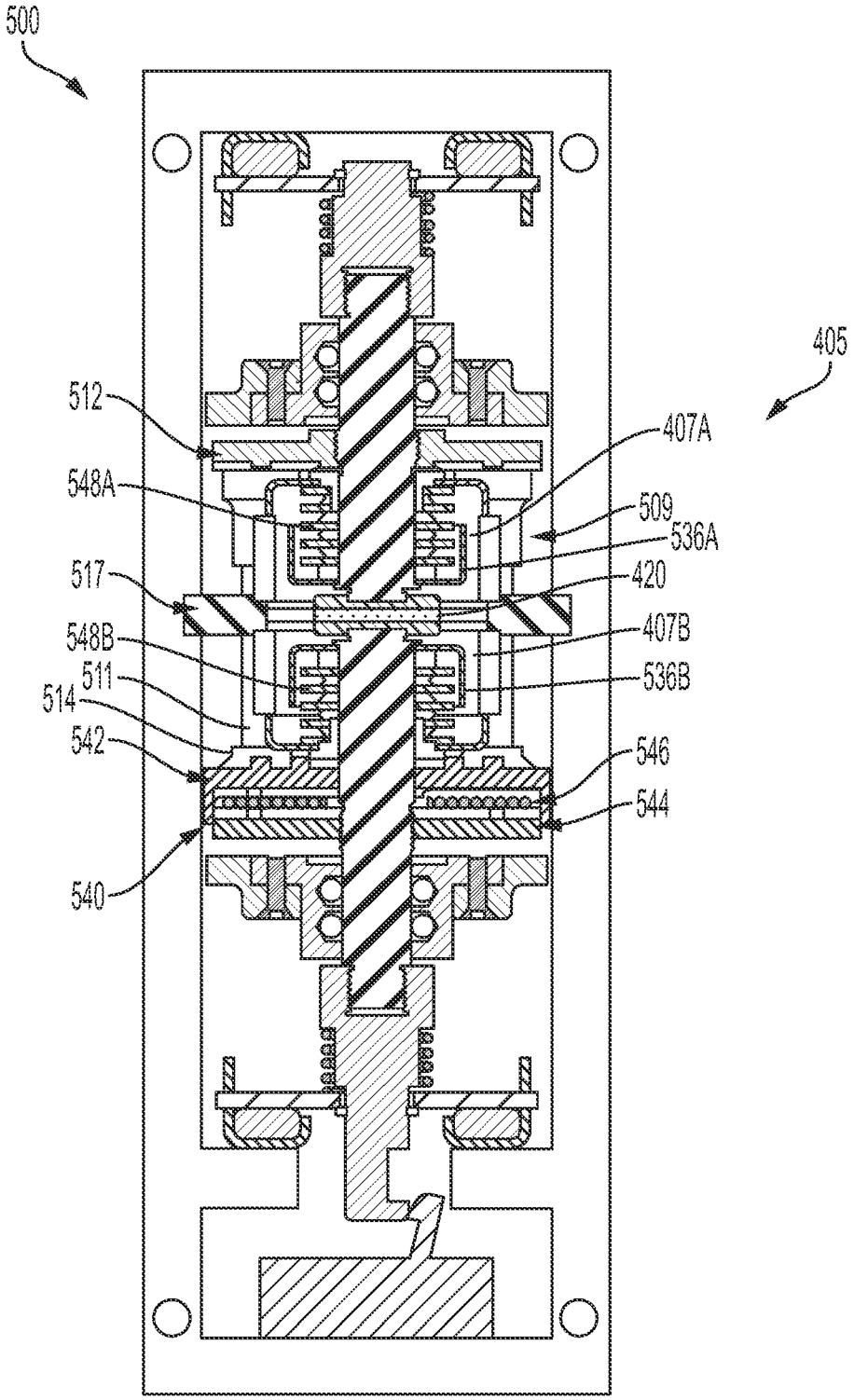
FIG. 5 is a sectional view of a circuit breaker having the dual contact housing sections of FIG. 4A.

FIG. 4A is a sectional view of dual contact housing sections 416A and 416B and certain internal components of a vacuum interrupter 405 shown in a closed position. FIG. 4B is a sectional view of dual contact housing sections 416A and 416B and certain internal components of a vacuum interrupter 405 shown in an open position. FIG. 5 is a sectional view of a circuit breaker 500 of using the dual contact housing sections 416A and 416B. The circuit breaker 500 is similar to the circuit breaker 100. Thus, like parts so that only the differences will be described. The operation is also essentially the same and only the differences will be described.

The vacuum chamber 407 may include fixed dual contact housing sections 416A and 416B and a fixed center housing section 418 between the contact housing sections 416A, 416B. Each contact housing section 416A, 416B may include an insulated and hermetically sealed vacuum chamber portion 407A, 407B.

The vacuum interrupter 405 may also include a fixed central electrode 420 embedded within the fixed center housing section 418 at a position to touch each of the contacts 422A, 422B when the contacts are extended and the breaker is thus in a closed position. The fixed center housing section 418 may be include non-conducting insulating material that surrounds the fixed central electrode 420.

The vacuum interrupter 405 may include a first electrode 424A and a second electrode 424B. Each electrode 424A, 424B has a portion of its length within a corresponding one of the vacuum chamber portions 407A or 407B. Specifically, a portion of the length of first electrode 424A is within the first vacuum chamber portion 407A. Additionally, a portion of the length of second electrode 424B is within the second vacuum chamber portion 407B. First electrode 424A is connected to a first contact 422A, and second electrode 424B is connected to a second contact 422B, that together form a pair of contacts 422A, 422B, each of which is positioned within a corresponding one of the vacuum chamber portions 407A or 407B. Additionally, each electrode 424A, 424B may be operatively connected to respective one of first or second moving linkage members 426A, 426B. The upward moving components in the configuration shown in FIGS. 4A-4B may include the first electrode 424A, the first contact 422A and the first moving linkage member 426A. The downward moving components in the configuration shown in FIGS. 4A-4B may include the second electrode 424B, the second contact 422B and the second moving linkage member 426B.

With specific reference to FIG. 5, the vacuum chamber portions 407A and 407B include features of chamber 107 previously described. The chamber 407 is coupled to a chamber travel assembly 509. The chamber travel assembly 509 may include a travel substrate 512 in proximity to a first end of the chamber 407, associated with chamber portion 407A. The chamber travel assembly 509 may include a support substrate 514 in proximity to the second end of the chamber 407, associated with chamber portion 407B. The upward moving components in the configuration may include the chamber travel assembly 509, which has connecting structures such as push rods 511. The rods 511 and the travel substrate 512 are non-conducting.

Each of the vacuum chamber portions 407A and 407B includes a bellows 548A, 548B that is also connected to a respective one of the first and second electrodes 424A, 424B. Each of the vacuum chamber portion 407A or 407B includes a cavity member 536A or 536B positioned to surround and protect its respective one bellow 548A or 548B from overheating during an interruption event. The bellows 548A may be configured to permit the first contact 422A and the first electrode 424A of the upward moving components to move whether from a closed position to an open position or an open position to a closed position. The bellows 548B may be configured to permit the second contact 422B and the second electrode 424B of the upward moving components to move whether from a closed position to an open position or an open position to a closed position.

The vacuum chamber 407 may include support member 517 configured to affix the non-conducting insulating material of the fixed center housing section 418 to the circuit breaker housing (i.e., housing 202). The rods 511 are configured to slide within the support member 517.

The circuit breaker 500 may include an ultrafast actuator 540 configured to generate a single repulsion force. The ultrafast actuator 540 may include an actuator member 546 and first and second repulsion plates 542, 544. By way of non-limiting example, the first and second repulsion plates 542, 544 may be placed on either side of actuator member 546 and are conductive. As with the embodiment of FIGS. 1-3, in this embodiment the actuator member 546 may be energized using capacitor or DC energy source (not shown in this embodiment). Also as with the previous embodiment, here the actuator member 546 may be a single Thomson coil or a piezo-electric actuator to create the single repulsion force.

However, unlike in the previous embodiment, when the actuator member 546 actuates, the vacuum chamber portions will not move. Instead, vacuum chamber portions 407A and 407B will remain fixed. As repulsion plate 542 moves upward, the first electrode 424A and first contact 422A move upward by a first distance portion in the first vacuum chamber portion 407A and away from a first side of the fixed central electrode 420 (FIG. 4B). The travel substrate 512 moves independent of the chamber portion 407A. As the repulsion plate 542 repels the support substrate 514 in proximity to the second end of the chamber 407 connecting structures such as push rods 511 apply pressure or a lifting force to travel substrate 512. As the travel substrate 512 moves upward, so does the first electrode 424A and connected first contact 422A.

As repulsion plate 544 moves downward, the second electrode 424B and second contact 422B move downward by a second distance portion in the second vacuum chamber portion 407B and away from a second side of the fixed central electrode 420, as seen in FIG. 4B. The first side and the second side of the fixed central electrode 420 are opposite sides. The first distance portion and the second distance portion provides the contact gap distance between the first contact 422A and the second contact 422B.

To open the vacuum interrupter 405, the ultrafast actuator 540 may provide a force greater than the combined force by the atmospheric pressure and the contact force applicator (i.e., contact force applicator 260 of FIG. 2). The contact force applicator creates a compression force, which is derived from the first compression force generated by the first spring assembly (i.e., first spring assembly 262A of FIG. 2) and/or the second compression force generated by the second spring assembly (i.e., second spring assembly 262B of FIG. 2). The repulsion plates 542, 544 are repelled by the magnetic force generated by the Thomson coil (i.e., actuator member 546). As the repulsion plates 542, 544 are repelled, a repulsion force greater than the combined force by the atmospheric force and the contact force applicator, which closes the vacuum interrupter 405, causes the vacuum interrupter 405 to open.

The repulsion plates 542, 544 return to an initial position, which is essentially next to the actuator member 546 so that, the vacuum interrupter 405 returns to a closed position.

The circuit breaker 100 may be used in semiconductor switches that require a certain amount of voltage across it to turn on. This voltage is generated from the voltage drop in the vacuum interrupter chamber (e.g., sum of anode drop, cathode drop and the voltage due to the arc).

The circuit breaker 500 may be used in semiconductor switches that may experience two arcs at two different locations, so that with lesser opening between the contacts, the voltage generated across it will be higher considering both the arc voltages and the drop in all the electrodes. Accordingly, the circuit breaker 500 may allow for a slower opening operation, which means lesser force requirement.

The circuit breaker 100 or 500 may be used by a power distribution company in a power system that is configured to provide a continuous supply of power to the end customers be it residential loads or industrial. The circuit breaker may be used, for example, at a start point of a distribution system as a low-voltage vacuum interrupter. The circuit breaker may be configured to protect downstream devices from the surge of current arising from a fault. The circuit breaker may be configured to interrupt a fault current, as quickly as possible, in order to reduce the let through energy. During a fault condition, the vacuum chamber(s) may require maintenance or a replacement depending on how many faults it experiences. Nonetheless, the circuit breaker 100 or 500 is configured to provide an ultrafast interruption of a high fault current to be commutated by the power system.

The circuit breaker 100 or 500 may be used in a hybrid circuit breaker device described below in relation to FIG. 5.

Figure 6:
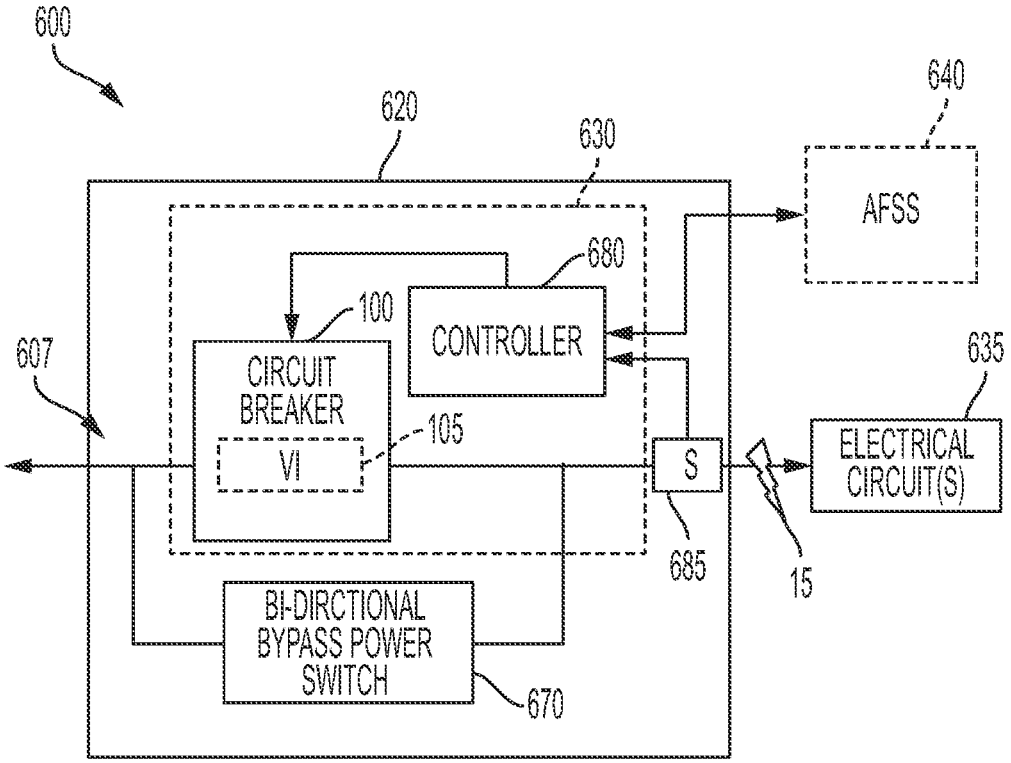
FIG. 6 is a block diagram of a system employing a hybrid circuit breaker.

FIG. 6 illustrates a block diagram of a system 600 employing a hybrid circuit breaker device 620 that may include a circuit breaker 100 with a bi-directional bypass power switch 670. FIG. 6 will be described in relation to circuit breaker 100 of FIGS. 1-3. However, the circuit breaker 500 also may be used in place of circuit breaker 100 in system 600.

The system 600 may include at least one electrical circuit 635. The at least one electrical circuit 635 may be a sub-component of an electrical power machine or an element of electrical distribution equipment. For example, the machine or equipment may include switchgear, a switchboard or a panelboard. The at least one electrical circuit 635 may include an electrical power circuit.

The hybrid circuit breaker device 620 may include an arc flash mitigation device 630 that includes the circuit breaker 100 and a system controller 680. The hybrid circuit breaker device 620 may include a bi-direction bypass power switch 670. When the arc flash mitigation device 630 is armed, the hybrid circuit breaker device 620 is configured to interrupt a detected fault current, such as a flash of light 15, which is commuted by the power switch 670. The power switch 670 may be a semiconductor switch.

The hybrid circuit breaker device 620 may include a path of least resistance 607. The path of least resistance 607 includes the circuit breaker 100 and specifically, the vacuum interrupter (VI) 105 and contacts 122A and 122B, shown in FIG. 1. In normal operation, the vacuum interrupter 105 is closed, as seen in FIG. 2, so that a closed circuit is formed along the path of least resistance 607. The closed circuit allows current to flow to through the path of least resistance 607 to the at least one electrical circuit 635. In FIG. 1, the vacuum interrupter 105 is open so that an open circuit is formed along the path of least resistance 607. The open circuit causes the fault signal flow to the bi-directional bypass power switch 670 where the fault current is commuted.

Arc flash mitigation device 630 also may include a current sensor 685 at an output of the path of least resistance 607 to provide a fault signal to the system controller 680, in response to detecting a very high level of fault current in the system 600.

The system 600 may include an arc flash sensor system (AFSS) 640 that is configured to sense an arc flash event, such as a flash of light 15 or a current representative of an arc flash, downstream of the arc flash mitigation device 630. In response to detecting the flash of light 15, arc flash sensor system 640 may provide a fault signal to the system controller 680 of the arc flash mitigation device 630. The arc flash sensor system 640 may include an arc flash sensor and/or other sensors (not shown). The detection of a flash of light and generation of the fault signal will occur more quickly than a standard current sensing branch breaker may act, and even more quickly than the system's main breaker may act.

The arc flash mitigation device 630 may be electrically connected to arc flash sensor system 640. Specifically, the arc flash sensor of the arc flash sensor system 640 may include a vision system with one or more optical sensors, such as cameras or other image capture devices that can detect a flash of light 15. Arc flash sensor system 640 may include a flash sensor controller (not shown) that is separate from the controller 680 of arc flash mitigation device 630. The arc flash sensor of the arc flash sensor system 640 may include an Arcflash Reduction Maintenance System™ (ARMS) by Eaton® Corporation or another suitable current sensor system. In operation, the arc flash sensor system 640 is configured to visually detect illumination of the flash of light 15. In response to detection of the flash of light 15, arc flash sensor system 640 may communicate a fault signal to the arc flash mitigation device 630. The fault signal may denote detection of an arc flash event. The flash sensor controller (not shown) may use image processing, feature extraction or other machine learning algorithms to detect from an image a level of illumination representative of an arc flash event. In other embodiments, the optical sensor may detect or sense a level of illumination.

Upon receiving a fault signal from arc flash sensor system 640 or the current sensor 685, controller 680 may send a trigger signal to circuit breaker 100. Specifically, the trigger signal may be sent to the actuator member 146 (FIGS. 1-3) which in turn opens the vacuum interrupter 105 by separating contacts 122A and 122B (as shown in FIG. 1) so that the fault current may be commuted by the bypass power switch 670.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A circuit breaker comprising:

a vacuum interrupter comprising:

a first movable electrode to which a first contact is connected, and a second movable electrode to which a second contact is connected, wherein:

the vacuum interrupter is operable between an open state and a closed state, in the open state, the first contact and the second contact are separated by a contact gap, and in the closed state, the first contact and the second contact touch each other; and an ultrafast actuator that is operatively connected to each of the first and second movable electrodes and configured to change the vacuum interrupter from the closed state to the open state by simultaneously moving:

the first contact in a first direction along a first distance portion of the contact gap, and the second contact in a second direction along a second distance portion of the contact gap, wherein the ultrafast actuator comprises a Thomson coil or a piezo-electric actuator.

2. The circuit breaker of claim 1, wherein:

the ultrafast actuator further comprises:

a first repulsion plate that is operatively coupled to the first movable electrode, and a second repulsion plate that is operatively coupled to the second movable electrode; and the Thomson coil or the piezo-electric actuator is disposed between the first repulsion plate and the second repulsion plate.

3. The circuit breaker of claim 2, further comprising:

a vacuum interrupter housing that is configured to house the first movable electrode, the first contact, the second movable electrode and the second contact, a chamber travel assembly that comprises:

a travel substrate that is movably coupled relative to a first end of the vacuum interrupter housing, a support plate that is coupled to the first repulsion plate and movably coupled relative to a second end of the vacuum interrupter housing, and parallel rods that connect the support plate to the travel substrate.

4. The circuit breaker of claim 3, wherein:

the vacuum interrupter further comprises a fixed central electrode;

the first contact is movably coupled relative to a first side of the central electrode by the first distance portion; and the second contact is movably coupled relative to a second side of the fixed central electrode by the second distance portion, the first side and the second side are opposite sides.

5. The circuit breaker of claim 4, wherein the vacuum interrupter housing comprises:

a first housing section that is configured to receive and house the first contact;

a second housing section that is configured to receive and house the second contact; and a housing divider section comprising the fixed central electrode, wherein the housing divider section is between the first housing section and the second housing section.

6. The circuit breaker of claim 2, further comprising a contact force applicator, the contact force applicator comprises:

a first spring assembly comprising a first compression spring that is configured to generate a first compression force that will force the first movable electrode and the first contact toward the second contact; and a second spring assembly comprising a second compression spring that is configured to generate a second compression force that will force the second movable electrode and the second contact toward the first contact.

7. The circuit breaker of claim 6, wherein:

the first compression force is in a direction opposite the first direction of the force generated by the first repulsion plate;

the second compression force is in a direction opposite the second direction of the force generated by the second repulsion plate; and the first compression force and the second compression force reduce the contact gap distance between the first contact and the second contact to cause the closed state of the vacuum interrupter.

8. The circuit breaker of claim 1, wherein the first distance portion of the contact gap and the second distance portion of the contact gap are equal.

9. A method for operating a circuit breaker, the method comprising:

providing a vacuum interrupter that is operable to move from a closed state an open state, wherein:

the vacuum interrupter comprises:

a first movable electrode to which a first contact is connected, and a second movable electrode to which a second contact is connected, and in the open state, the first contact and the second contact are separated by a contact gap, and in the closed state, the first contact and the second contact touch each other;

operating an ultrafast actuator that is operatively connected to the first and second movable electrodes to change the vacuum interrupter from the closed state to the open state by simultaneously moving:

the first contact in a first direction along a first distance portion of the contact gap, and the second contact in a second direction along a second distance portion of the contact gap, wherein the ultrafast actuator comprises a Thomson coil or a piezo-electric actuator.

10. The method of claim 9, wherein:

the ultrafast actuator further comprises:

a first repulsion plate that is operatively coupled to the first movable electrode, and a second repulsion plate that is operatively coupled to the second movable electrode;

the Thomson coil or the piezo-electric actuator is disposed between the first repulsion plate and the second repulsion plate; and operating the ultrafast actuator to change the vacuum interrupter from the closed state to the open state further comprises simultaneously:

moving the first repulsion plate away from the second repulsion plate, which in turn moves the first movable electrode in a first direction, and moving the second repulsion away from the first repulsion plate, which in turn moves the second movable electrode in a second direction that is opposite the first direction.

11. The method of claim 10, wherein the vacuum interrupter further comprises a vacuum interrupter housing that is configured to house the first movable electrode, the first contact, the second movable electrode and the second contact.

12. The method of claim 11, wherein:

the vacuum interrupter further comprises a fixed central electrode in the vacuum interrupter housing; and operating the ultrafast actuator to change the vacuum interrupter from the closed state to the open state further comprises simultaneously moving:

the first contact by the first distance portion relative to a first side of the central electrode, and the second contact by the second distance portion relative to a second side of the central electrode, the first side and the second side are opposite sides.

13. The method of claim 12, wherein:

the vacuum interrupter housing comprises:

a first housing section that is configured to receive and house the first contact, a second housing section that is configured to receive and house the second contact, and a housing divider section comprising the fixed central electrode;

the moving of the first contact further comprises moving the first contact within the first housing section of the vacuum interrupter housing, in response to moving the first contact relative to the first side of the central electrode; and the moving of the second contact further comprises moving the second contact within the second housing section, in response to moving the second contact relative to the second side of the central electrode.

14. The method of claim 11, wherein:

the circuit breaker further comprises:

a first spring assembly that is coupled to the first movable electrode, and a second spring assembly that is coupled to the second movable electrode; and the method further comprises:

generating by the first spring assembly a first compression force that forces the first movable electrode having the first contact toward the movable second electrode and the second contact, and generating by the second spring assembly a second compression force that forces the second movable electrode having the second contact toward the first movable electrode and the first contact.

15. The method of claim 14, wherein:

the first compression force is in a direction opposite the first direction of the force generated by the first repulsion plate;

the second compression force is in a direction opposite the second direction of the force generated by the second repulsion plate; and the first compression force and the second compression force reduce the contact gap distance between the first contact and the second contact to cause the closed state of the vacuum interrupter.

16. The method of claim 9, wherein the first distance portion of the contact gap and the second distance portion of the contact gap are equal.

* * * * *